United States Patent [19]

Nakatsuji

[11] 4,126,917

[45] Nov. 28, 1978

[54] TIE PIN SHIRT ENGAGING MEANS

[76] Inventor: Minoru Nakatsuji, 6-4, 4-chome, Higashi-cho, Kichijoji, Musashino-shi, Tokyo-to, Japan

[21] Appl. No.: 762,413

[22] Filed: Jan. 25, 1977

[30] Foreign Application Priority Data

Sep. 10, 1976 [JP] Japan ..... 51-122063

[51] Int. Cl.[2] ..... A44B 9/00

[52] U.S. Cl. ..... 24/85 R

[58] Field of Search ..... 24/85 R, 85 A, 49 R, 24/49 CF, 49 CC, 49 CP, 73 CE, 73 CS, 81 AB

[56] References Cited

U.S. PATENT DOCUMENTS

| | | | |
|---|---|---|---|
| 745,445 | 12/1903 | Von Köppen | 24/49 CP |
| 1,109,283 | 9/1914 | Elmore | 24/49 CP |
| 1,380,459 | 6/1921 | Youngs | 24/49 CP |
| 2,002,195 | 5/1935 | Trout | 24/73 CS |
| 2,084,503 | 6/1937 | Rogers | 24/73 CS |
| 2,893,086 | 7/1957 | Parker | 24/49 CP |
| 3,357,063 | 12/1967 | Eiben | 24/49 P |
| 3,535,748 | 10/1970 | Lely | 24/49 CP |

*Primary Examiner*—Doris L. Troutman
*Attorney, Agent, or Firm*—Flynn & Frishauf

[57] ABSTRACT

A tie pin comprises a clip member with a precious stone for fixing a necktie to the brim or edge of a shirt, a clamp member having a shirt piercing pin and means for engaging the pin, and a chain connected between said clip member and said clamp member.

3 Claims, 3 Drawing Figures

TIE PIN SHIRT ENGAGING MEANS

This invention relates to a tie pin used in clipping a necktie to the brim or edge of a shirt.

A prior tin pin includes a clip member having no pin for piercing a shirt. Such a prior art tie pin has a snap ring which engages with a button attached to a man's shirt so as to prevent the tie pin from being lost when the clip member is unfastened from the tie.

Such tie pin has some defects, one of which is that the snap ring must be disengaged from the button each time of changing of shirts, and the other is that the snap ring may fall off together with a precious stone as well as the clip member if it is badly engaged with the button.

Another prior tie pin includes a clip member having a piercing pin, which ensures to engage the necktie with the brim of the shirt. However, such a tie pin unavoidably causes damage to the necktie cloth by piercing same.

SUMMARY OF THE INVENTION

An object of this invention is to provide an improved tie pin comprising a clip member having no piercing pin and a clamp member having a piercing pin which is used only for fastening the clip member to the shirt brim. The clamp member is attached to the clip member by a chain.

DETAILED DESCRIPTION

Figure 1:
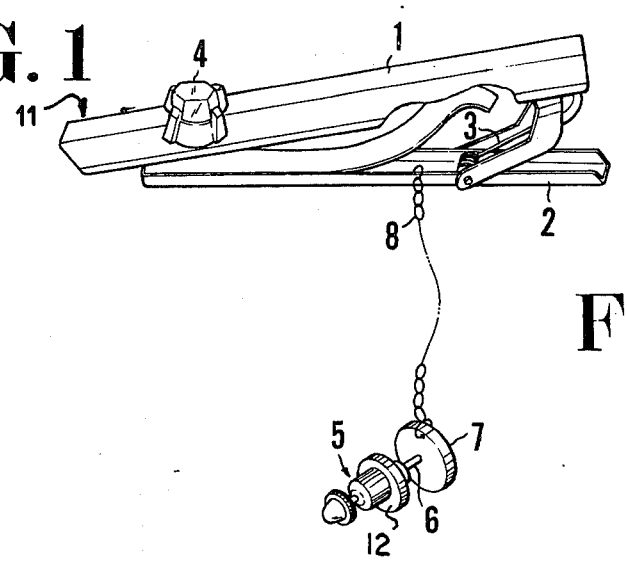
FIG. 1 is a perspective view of an embodiment of this invention.

Referring to FIG. 1, a tie pin embodying this invention comprises a clip member 11 having a bar shaped pedestal 1, a clipping piece 2 pivoted to said pedestal 1 at its end, and a coil spring member 3 for biassing the clipping piece 2 against the back of the pedestal 1. To the front face of the pedestal 1 is attached a precious stone 4 such as a diamond or a ruby. The tie pin further comprises a clamp member 5 having a piercing pin 6 which is mounted to a base 7, and a chain 8 having a suitable length and connecting the base 7 of the clamp member 5 with the clipping piece 2 of the clip member 11. Said clamp member 5 may include a chuck means 12 for chucking the piercing pin or needle 6, as known in the prior tie tack art.

In operation, the clamp member 5 is fixed to the brim or free edge of the shirt with the piercing pin 6 passing through the cloth of the shirt and into the chuck means 12. The tie is clipped by the clip member 11 between the pedestal 1 and clipping piece 2. In this case, the necktie cloth is not damaged, and the clamp member 5 with the pin 6 ensures fixing of the tie pin to the shirt brim. As the tie pin of this invention is used, anybody can change his shirt with the clamp member 5 being fixed to the shirt brim, so that he avoids the tie pin with the precious stone from being lost during the shirt changing operation.

Figure 2:
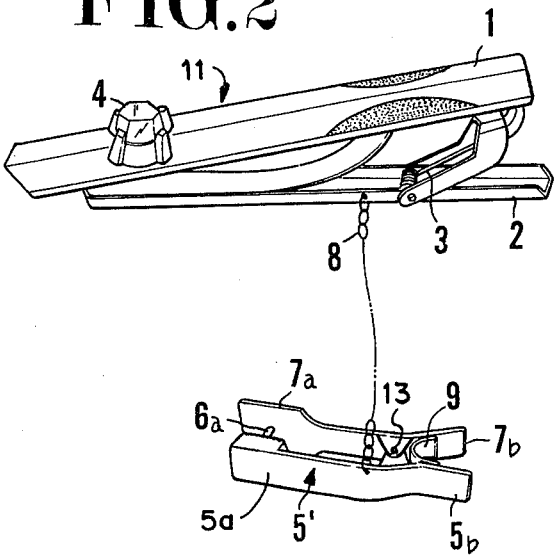
FIG. 2 is a perspective view of another embodiment of this invention.

FIG. 2 illustrates another embodiment of this invention in which there is a clamp member 5' having a different construction from the above-mentioned case.

Figure 3:
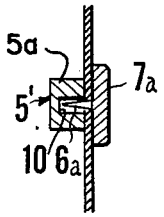
FIG. 3 is a cross-sectional view of the clamping member shown in FIG. 2.

The clamp member 5' in FIG. 2 comprises a piercing pin 6*a* extending from a bar member 7*a* having a push lever portion 7*b*, and a U-shaped spring member 9. The clamp member 5' has a second bar member 5*a*, with a push lever portion 5*b*, which is pivoted to the first bar member 7*a* at pivot 13. The spring member 9 is inserted between the levers 5*b* and 7*b* so as to spring bias the needle 6*a* to urge it into a bore 10 formed in the second bar member 5*a* of the clamp member 5', as seen in FIG. 3.

In operation, the clamp member 5' is fixed to the lined brim of the shirt with the needle 6*a* inserting through the brim cloth into the bore 10 of the second bar member 5*a* of the clamp member 5', and the necktie is clipped by the clip member 11 in the same manner as in the first embodiment.

What is claimed is:

1. A tie pin comprising:

a clip member (11) or non-piercingly engaging a tie, said clip member including a pedestal (1), a clipping piece (2) pivoted to said pedestal and a spring member (3) for biassing said clipping piece against the back of said pedestal to engage a tie between said pedestal and said clipping piece, said pedestal having a precious stone or ornament attached thereto;

a clamp member (5) having a base member (7), a shirt piercing pin (6) mounted on said base member and extending therefrom, and chuck means (12) for engaging said pin (6) after it pierces a shirt for fixedly connecting said clamp member to the shirt; and a flexible elongated chain having a predetermined length and fixedly connected to both said clamp member and said clip member for retaining said clip member (11) to said clamp member (5) while permitting substantial relative movement therebetween.

2. A tie pin comprising:

a clip member (11) for non-piercingly engaging a tie, said clip member including a pedestal (1), a clipping piece (2) pivoted to said pedestal and a spring member (3) for biassing said clipping piece against the back of said pedestal to engage a tie between said pedestal and said clipping piece, said pedestal having a precious stone or ornament attached thereto;

a clamp member (5') including a first elongated bar member (7*a*) having a push lever portion (7*b*), a shirt piercing pin (6*a*) mounted on said first bar member and extending therefrom, and means (5*a*) for engaging said pin after it pierces a shirt for fixedly connecting said clamp member to the shirt, said engaging means including a second bar member (5*a*) pivotally connected (13) to said first bar member (7*a*) and having a push lever portion (5*b*) opposed to said push lever portion (7*b*) of said first bar member (7*a*), said second bar member (5*a*) having a bore (10) therein for at least partially receiving said pin (6*a*) after it pierces a shirt, and a spring member (9) coupled between said first and second bar members (7*a*,5*a*) for spring biassing said pin to springingly urge said pin into said bore (10) in said second bar member; and a flexible elongated chain having a predetermined length and fixedly connected to both said clamp member and said clip member for retaining said clip member (11) to said clamp member (5') while permitting substantial relative movement therebetween.

3. The tin pin of claim 8 wherein said pivotal connection (13) between said first and second bar members is located between said pin (6*a*) and said spring member (9), said spring member biassing said push portions (7*b*,5*b*) of said first and second bar members, respectively, away from each other.

* * * * *